US008834133B2

(12) United States Patent
Porel

(10) Patent No.: US 8,834,133 B2
(45) Date of Patent: Sep. 16, 2014

(54) PUMPING DEVICE FOR FLUIDS LOCATED AT THE BOTTOM OF A DRILLED WELL

(75) Inventor: Louis-Claude Porel, Jeanmenil (FR)

(73) Assignee: BP Corporation North America Inc., Houston, TX (US)

( * ) Notice: Subject to any disclaimer, the term of this patent is extended or adjusted under 35 U.S.C. 154(b) by 647 days.

(21) Appl. No.: 12/881,512

(22) Filed: Sep. 14, 2010

(65) Prior Publication Data

US 2012/0034113 A1 Feb. 9, 2012

(30) Foreign Application Priority Data

Aug. 5, 2010 (FR) ..... 10 56478

(51) Int. Cl.
*F04B 17/00* (2006.01)
*E21B 43/12* (2006.01)
*F04B 47/08* (2006.01)

(52) U.S. Cl.
CPC ..... *E21B 43/129* (2013.01); *F04B 47/08* (2013.01); *Y10S 417/902* (2013.01)
USPC ..... 417/271; 417/365; 417/902; 166/105

(58) Field of Classification Search
USPC ..... 417/398, 399, 269, 405, 271, 546, 904, 417/366, 365, 902; 166/105, 369; 277/359–360, 370, 362, 363, 371, 399, 277/400, 404, 406, 503, 505, 507; 384/255, 384/426, 447
See application file for complete search history.

(56) References Cited

U.S. PATENT DOCUMENTS

| | | | | | |
|---|---|---|---|---|---|
| 1,740,682 | A | * | 12/1929 | Carrey | 277/398 |
| 2,431,492 | A | * | 11/1947 | Lewis | 417/271 |
| 2,972,955 | A | * | 2/1961 | Richter et al. | 91/486 |
| 3,075,778 | A | * | 1/1963 | Bowers et al. | 277/388 |
| 3,398,694 | A | * | 8/1968 | Lerch | 417/366 |
| 3,589,838 | A | | 6/1971 | Tucson | |
| 4,406,598 | A | | 9/1983 | Walling | |
| 4,478,557 | A | * | 10/1984 | Schott | 417/271 |
| 4,486,152 | A | * | 12/1984 | Porel | 417/270 |
| 4,597,722 | A | | 7/1986 | Tichy | |
| 4,738,595 | A | * | 4/1988 | Gaiser | 417/36 |
| 4,771,832 | A | * | 9/1988 | Bridges | 166/380 |
| 4,787,828 | A | * | 11/1988 | Schweitzer et al. | 417/271 |
| 4,880,363 | A | | 11/1989 | Holland et al. | |

(Continued)

FOREIGN PATENT DOCUMENTS

EP 1916380 A1 4/2008

OTHER PUBLICATIONS

PCT/US2010/061871 International Search Report and Written Opinion dated Jul. 29, 2011 (40043-00) (8 p.).

(Continued)

*Primary Examiner* — Devon Kramer
*Assistant Examiner* — Charles W Nichols
(74) *Attorney, Agent, or Firm* — Gunnar Heinisch

(57) ABSTRACT

Device for pumping fluid located under conditions of high ambient temperature and pressure which must deliver at high pressure including a hydraulic delivery pump (11) linked to a hydraulic motor (40), characterized in that the hydraulic motor (40) is connected to the hydraulic delivery pump (10) by a shaft (41), the shaft (41) passing through a leaktight rotating seal (50) which separates the hydraulic fluid (42) returned from the hydraulic motor (40) from the lubricating fluid (5) for the hydraulic pump (10).

12 Claims, 3 Drawing Sheets

(56) References Cited

U.S. PATENT DOCUMENTS

| | | | | |
|---|---|---|---|---|
| 5,067,753 | A * | 11/1991 | Porel | 285/279 |
| 6,273,188 | B1 | 8/2001 | McCafferty et al. | |
| 6,811,709 | B2 | 11/2004 | Arnaud | |
| 7,059,881 | B2 | 6/2006 | Song et al. | |
| 7,249,634 | B2 * | 7/2007 | de Albuquerque Lima Goncalves et al. | 166/335 |
| 7,374,005 | B2 * | 5/2008 | Gray, Jr. | 180/165 |
| 7,730,937 | B2 | 6/2010 | Head | |
| 8,177,526 | B2 | 5/2012 | Dowling et al. | |
| 2004/0042906 | A1 | 3/2004 | Gleasman et al. | |
| 2004/0144534 | A1 | 7/2004 | Lee | |
| 2005/0095144 | A1 | 5/2005 | Shimizu | |
| 2005/0167116 | A1 * | 8/2005 | Lima Goncalves et al. | 166/352 |
| 2006/0045781 | A1 | 3/2006 | Liknes | |
| 2006/0120884 | A1 * | 6/2006 | Nozaki | 417/269 |
| 2006/0289170 | A1 | 12/2006 | Wood | |
| 2007/0022751 | A1 | 2/2007 | Galba | |
| 2008/0080991 | A1 | 4/2008 | Yuratich et al. | |
| 2009/0211753 | A1 | 8/2009 | Emtiazian et al. | |
| 2009/0218091 | A1 | 9/2009 | Dotson | |
| 2010/0143166 | A1 | 6/2010 | Head | |
| 2011/0186302 | A1 | 8/2011 | Coyle et al. | |

OTHER PUBLICATIONS

Office Action dated Feb. 15, 2013; U.S. Appl. No. 12/976,363 (40043-00) (25 p.).

Manring, Noah D., "Hydraulic Control Systems", 2005, John Wiley & Sons, ed. 1, 279-301 (25 p.).

* cited by examiner

PUMPING DEVICE FOR FLUIDS LOCATED AT THE BOTTOM OF A DRILLED WELL

This invention relates to the technology of drilled wells producing fluids which it is attractive to extract.

As these wells may be of very great depth—several thousand meters—a pumping mechanism capable of delivering well fluid under pressures of several hundred bars is required.

The depth of these wells gives rise to a high temperature of over 200—the pumping mechanism must be designed to withstand high temperatures.

The fluid delivered may be of very low viscosity, so the pumping mechanism must be capable of delivering a low viscosity fluid at high pressure (well depth).

According to the invention the mechanism for pumping well fluids capable of delivering a very hot fluid of very low viscosity at high pressure comprises the combination of a hydraulic pump and a hydraulic motor, the hydraulic motor driving the said pump, this combination being made possible through a rotating seal which is essential for proper functioning of the motor. The associated hydraulic pump and motor are located at the bottom of the well.

The fluids pumping device located at the bottom of drilled wells according to the invention is characterised in that it comprises a combination of a hydraulic pump and a hydraulic motor driving the said pump through the intermediary of a rotating seal which ensures a leaktight seal between the hydraulic motor and the hydraulic pump.

Depending upon the embodiment, the invention also comprises all or some of the following:

a) The hydraulic pump is a piston pump,
b) The pistons of the hydraulic pump are axial pistons which bear against an angled plate,
c) The hydraulic motor is a piston motor,
d) The pistons of the hydraulic motor are axial pistons which bear against an angled plate,
e) The hydraulic motor is supplied from the surface of the well at a pressure higher than the delivery pressure of the delivery pump, and the cylinder capacities of the pump and the motor are the same or virtually the same,
f) The hydraulic fluid present in the body of the hydraulic motor is at the same pressure as the static pressure provided by the depth of the well,
g) The leaktight rotating seal comprises a thrust member having a spherical head which is excentric in relation to the axis of rotation of the shaft, the said thrust member resting against a tapering block, the thrust member and the tapering block having the shaft passing through them,
h) The leaktight rotating seal comprises two thrust members having spherical heads located on either side of a double-tapering block, the spherical head of one of the thrust members being off centre in relation to the axis of rotation of the shaft,
i) Provision is made for slight leakage flow from the rotating seal, which passing through a non-return valve communicates with the internal volume of the well, which is filled with a compound,
j) Each piston is fitted with at least one inlet valve and one outlet valve,
k) The mechanical part of the hydraulic delivery pump is immersed in a lubricating fluid within a leaktight enclosure fitted with a piston accumulator impelled by a spring to slightly pressurise the lubricating fluid,
l) The hydraulic delivery pump incorporates inlet openings fitted with filters and non-return valves calibrated to a pressure greater than that of the delivery column, provided between the delivery column and the inlet openings in order to clear the filters,
m) The device comprises an enclosure and the exterior of the enclosure is in the form of a heat exchanger, for example with radial fins.

The invention will be better understood and other aims, details, characteristics and advantages thereof will be more clearly apparent in the course of the following description of various embodiments of the invention provided purely for illustration and without limitation with reference to the appended drawings.

In these drawings:

FIG. 1 shows the bottom of a well fitted with a pumping device according to the invention. The bottom of this well, having a diameter of 80 mm and a depth of the order of 3000 meters, is filled with a fluid which has to be pumped.

Space 1 within which the material which has to be pumped is located is at a temperature of the order of 200° or more and at a pressure of approximately 300 bar or more.

A hydraulic pump 10 designed to draw in fluid 2 and deliver it to the surface 3 is located in this bottom.

The viscosity of the fluid, its temperature and the pressure required to deliver the said fluid make it necessary to choose a pump technology capable of ensuring acceptable performance under these conditions. A piston pump fulfils these requirements.

Figure 1:
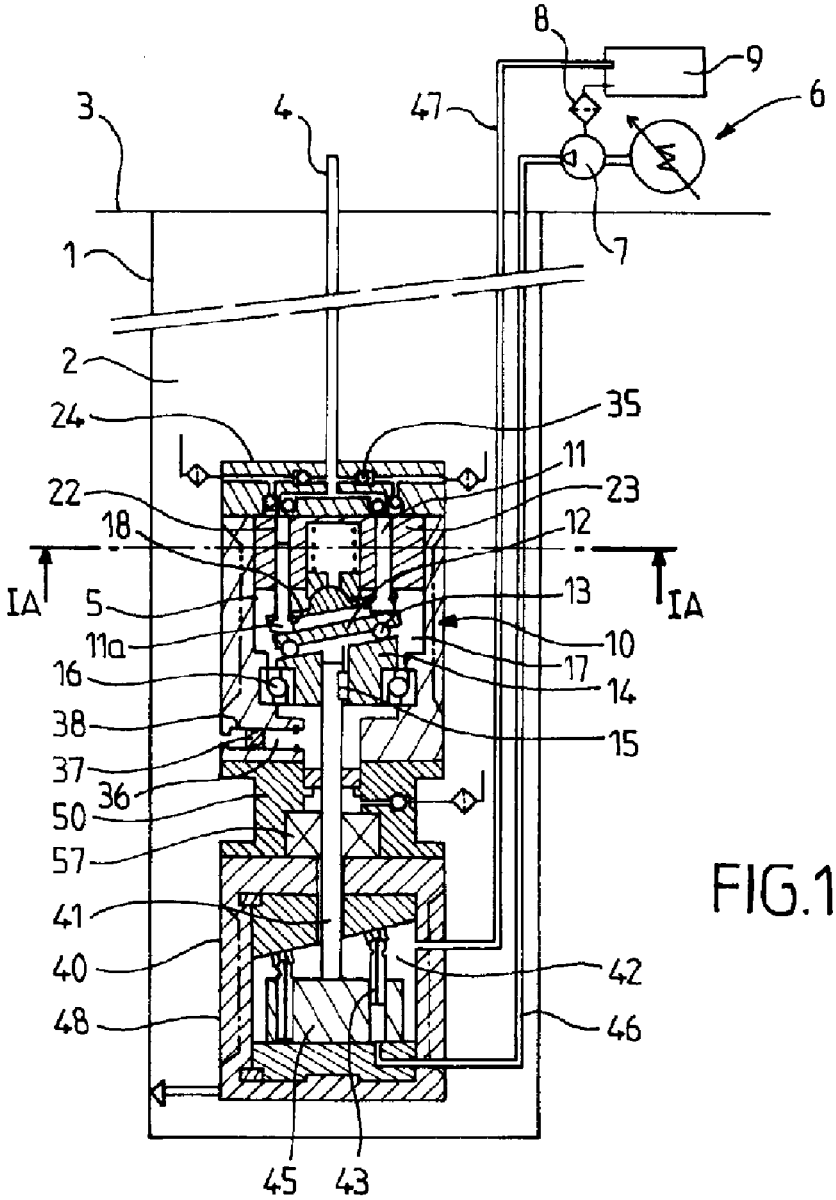
FIG. 1 is a diagrammatical view of an embodiment of the invention in longitudinal cross-section.
Figure 2:
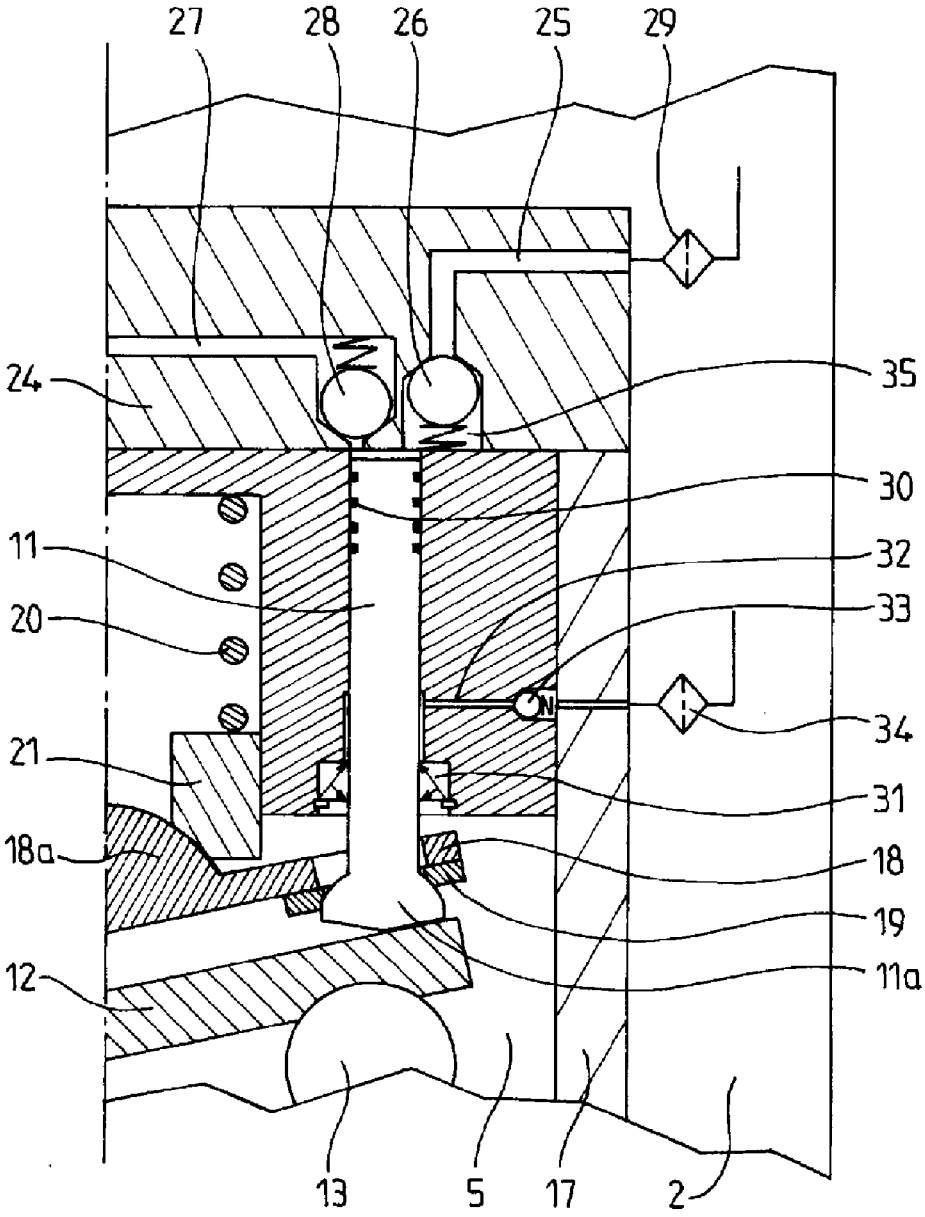
FIG. 2 is a magnified view of a detail in FIG. 1 illustrating in cross-section part of the pump which is visible in FIG. 1.

FIGS. 1 and 2 show a piston pump 10 of the axial piston type. Alternating movement of pistons 11 is brought about for example by means of a plate 12 on ball bearings 13 supported by a rotating inclined plate 14 against which the heads 11*a* of pistons 11 bear.

Rotation of inclined plate 14 of pump 10 transmits movement to ball-race plate 12 bringing about alternating movement of pistons 11. Inclined plate 14 is caused to rotate by a shaft 41 (which will be described below) through the intermediary of a key 15. Inclined plate 14 is supported by ball races 16 in a leaktight enclosure 17 within which the mechanical components of pump 10 are housed.

A thrust plate 18 through which pistons 11 pass bears through washers 19 on the heads 11*a* of pistons 11. A spring 20 presses thrust plate 18 against the heads 11*a* of pistons 11 via a tapering block 21 which bears against the spherical head 18*a* of thrust plate 18.

Pistons 11 slide in openings 22 passing through a fixed barrel 23. Openings 22 open onto a fixed part 24 in which inlet openings 25 fitted with inlet valves 26 are provided in order to draw in fluid 2, and delivery openings 27 fitted with delivery valves 28 to deliver fluid 2 towards a delivery column 4 which opens at the surface 2.

Each piston 11 is fitted with at least one inlet valve 26 and one delivery valve 28 (FIG. 2).

In order to protect delivery pump 10 from contaminants and impurities present in fluid 2, in particular on the inlet valve 26 side of pump 10, filters 29 are located on inlet openings 25 of the pump.

In order to ensure that the mechanical functioning of pump 10 is satisfactory a leaktight separation is made between hydraulic fluid 5 which lubricates the mechanical components of the pump and fluid 2 which has to be pumped.

In order to provide this seal, sealing segments 30, for example of the metal segments type, may be provided on the body of pistons 11 of the pump (FIG. 2).

In order to recover any leaks of fluid 2 towards lubricating fluid 5 a low pressure seal 31 may be provided at the heads of the pistons, together with a drainage opening 32, fitted with a calibrated valve 33 and if appropriate a filter 34, to drain any leaks towards fluid 2.

The metal segments are chosen in such a way as to create the minimum possible compressibility on the fluid side. With the same concern, deadspace 35 between the free ends of pistons 11 of the pump and its valves 26 and 28 will preferably be of minimum size. These arrangements are to be preferentially adopted so as to provide pump 10 with maximum compression power in relation to fluid 2 which has to be delivered.

As the fluid which has to be pumped may be contaminated, provision needs to be made to clear filters 29 which will become obstructed and render pump 10 inoperative.

For this purpose provision may for example be made (see FIG. 1) for non-return valves 35, always calibrated to a pressure higher than the delivery pressure 4 of the fluid, between delivery column 4 for the fluid and inlet openings 25 of pump 10.

The internal space within enclosure 17 is entirely filled with lubricating hydraulic fluid 5.

In order to prevent fluid 2 entering lubricating fluid from the mechanical part of delivery pump 10, provision may be made for slightly pressurising lubricating fluid 5 by locating a piston accumulator 37 loaded by a spring 38 between fluid 2 and lubricating fluid 5 in an opening 36 passing through enclosure 17.

This piston 37 can also be used to compensate for temperature changes and changes in the flow from the pump, and thus to produce a compensated leaktight space 17. Piston 37 allows the volume of said space 17 to vary slightly to compensate for cyclical changes in flow and to place the enclosure at the same pressure as fluid 2. This compensation may also be performed by a leaktight membrane.

The piston pump is driven by a hydraulic motor.

FIG. 1 shows a hydraulic motor 40 driven a motor/pump unit 6 located at the surface. This motor/pump unit 6, which is in itself known, comprises a pump 7 driven by a motor M, the said pump 7 being connected through a filter 8 to a reservoir 9 for hydraulic fluid.

In the embodiment illustrated in FIG. 1, pump 10 is driven by a hydraulic motor 40 having axial pistons 43 which is not housed in lubricating fluid 5 for the pump. Pistons 43 bear against a fixed angled plate 44 and slide in a rotating barrel 45.

The pressurised hydraulic fluid arrives via a pipe 46 and returns to motor/pump unit 6 through a pipe 47. Hydraulic motor 40, which is housed in an enclosure 48, is immersed in the return hydraulic fluid 42. The pipes connecting the hydraulic motor to motor/pump unit 6 are the normal inlet and outlet pipes for the feed openings for the hydraulic motor.

Pistons 43 are connected alternately to pipe 46 through which the pressurised fluid arrives and pipe 47 for return to the reservoir 9 of motor/pump unit 6 on the surface, through a flat plate glass distributor, which is not described in detail because it is well known and does not form part of the invention.

Rotating barrel 45 of hydraulic motor 40 is connected to rotating angled plate 14 by shaft 41.

There then arises the problem of providing a seal between hydraulic fluid 5 lubricating the mechanical part of the pump and hydraulic fluid 42 returned to hydraulic motor 40.

In fact there may be a significant pressure difference between the fluid in which the barrel of the hydraulic motor is immersed and the lubricating fluid for the pump.

This significant pressure difference raises the problem of providing a link between pump 10 and motor 40 which is both leaktight and rotating, and for this purpose shaft 41 passes through a seal 50, which is a rotating seal.

The technology of leaktight rotating seals is known, but in this case it has to operate at temperatures of the order of 200° C. with a pressure difference of at least the pressure obtaining in return line 47 from the hydraulic motor.

By way of example the invention provides two embodiments for rotating seal 50 (see FIGS. 3A and 3B) which are capable of holding a high external pressure against a low pressure while ensuring that a shaft rotating at high speed passes through them.

The two variants of rotating seals 50 provided have the property of creating small friction torques so as not to have an adverse effect on the performance of the transmission.

Figure 3A:
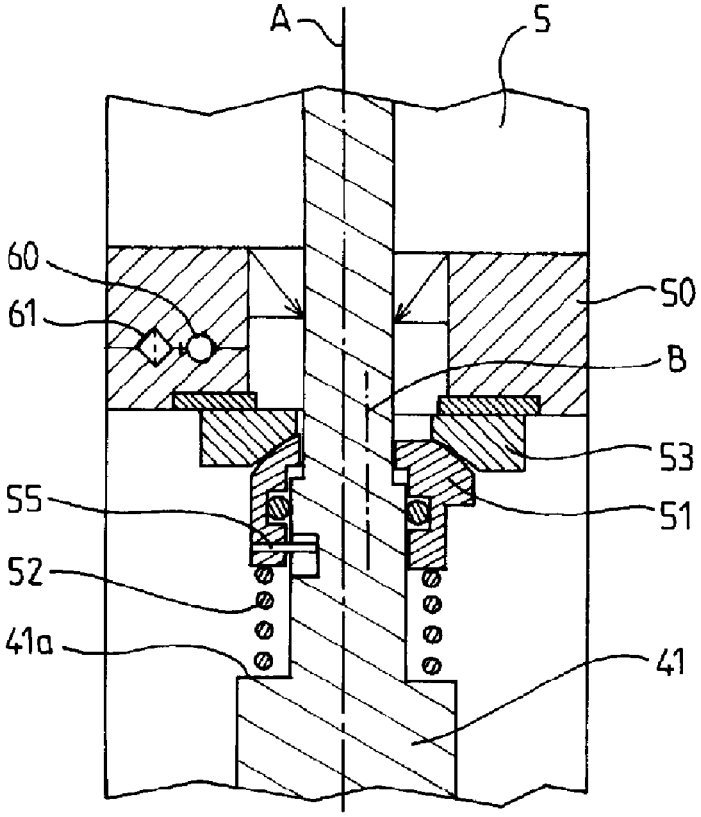
FIG. 3A is a magnified view of a detail in FIG. 1 illustrating in cross-section a first embodiment of a leaktight rotating seal.

With this object, in the example in FIG. 3A shaft 41 passes through a thrust member 51 whose spherical excentric head bears against a tapering block 53 through which shaft 41 also passes.

Thrust member 51 is caused to bear against block 53 by means of a spring 52 located between the base of thrust member 51 and a shoulder 41*a* on shaft 41.

The spherical head of thrust member 51 rotates together with rotating shaft 30 through a key 55. The axis of rotation B of the spherical head is excentric in relation to the axis of rotation A of shaft 41. Because of this the spherical head rotates with shaft 41 and causes a displacement movement of block 53. This movement ensures that a hydrostatic film is present beneath block 53 and thus ensures that it operates satisfactorily.

Figure 3B:
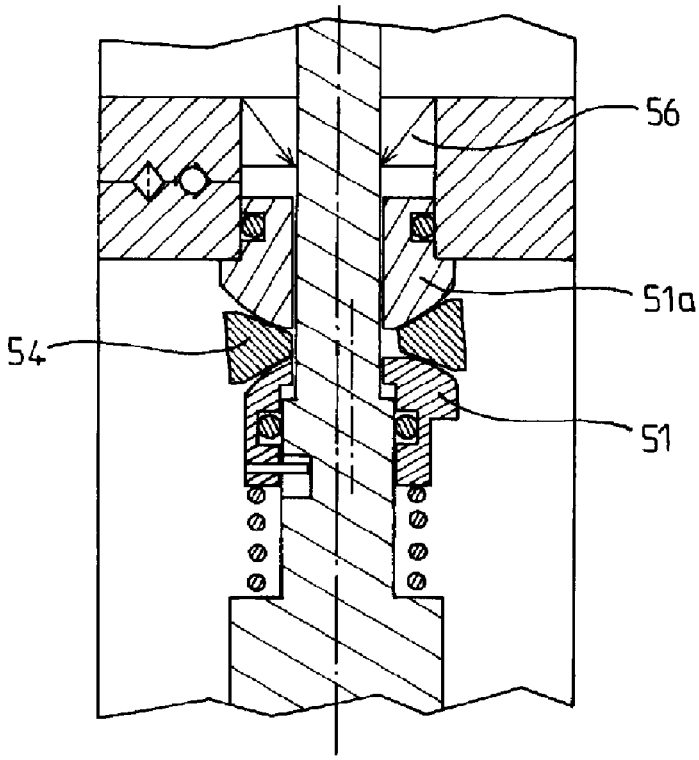
FIG. 3B is a magnified view of a detail in FIG. 1 illustrating in cross-section a second embodiment of a leaktight rotating seal.

FIG. 3B illustrates a variant operating on the same principle, the difference being that there are two thrust members 51 and 51*a* and block 53 is replaced by a double tapering block 54.

Only the head of thrust member 51 is excentric, causing double tapering block 54 to rotate.

It will be seen in FIG. 1 that around shaft 41 rotating seal 50 has a low pressure seal 56 on the side of pump 10 and a ball race 57 on the side of hydraulic motor 40.

These arrangements ensure that a slight high pressure leak towards the low pressure has the effect of preventing any possibility of fluid 2 entering within the hydraulic motor.

In order to prevent the risk of fluid 2 entering hydraulic motor 40 a slight high pressure leak towards the low pressure may be provided for.

With this object a slight leakage flow is provided in rotating seal 50, which passing through a non-return valve 60 communicates with space 1 containing fluid 2. Rotating seal 50 is designed so that any leaks flow in front of the radial seal at the end of the hydraulic pump. This flow is controlled to have a low pressure through non-return valve 60 which is slightly loaded by a spring.

Fluid 2 may be at 200° or more. Because of this the components of the motor and hydraulic pump assembly must work at high temperature and only fluid 2 can be regarded as being a heat exchange fluid.

Figure 1A:
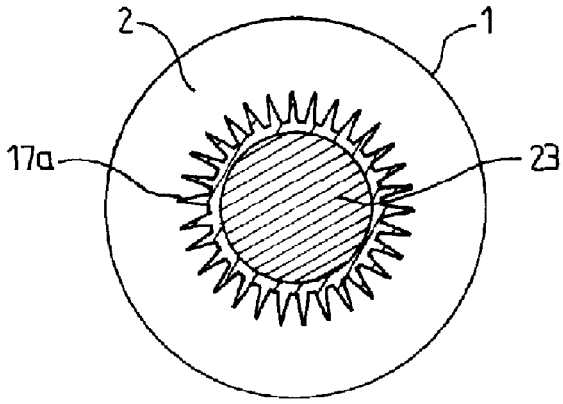
FIG. 1A is a view in transverse cross-section of FIG. 1 along the line IA-IA.

In order to prevent too great a temperature difference between the interior of the assembly of pump 10-40 located in the well and said fluid 2 the exterior of enclosures 17 and 48 of the said assembly may be constructed in the form of a heat exchanger, for example with radial fins 17*a* (see FIG. 1A, in which the openings in the barrel have been omitted for simplicity of illustration). The purpose of this arrangement is to make it closer to the temperature of the fluid.

Although the invention has been described in connection with several particular embodiments, it is obvious that it is not in any way restricted thereby and that it comprises all technical equivalents of the means described, including combinations thereof if they fall within the scope of the invention.

The use of an indefinite article "a" for one component does not unless mentioned otherwise exclude the presence of a plurality of such components.

In the claims no reference numbers between brackets may be interpreted as a restriction of the claim.

The invention claimed is:

1. A pumping device for pumping fluids located at the bottom of a drilled well, of the device comprising:

a housing, having a hydraulic pump enclosure and a hydraulic motor enclosure;

a hydraulic pump disposed within the housing;

a hydraulic motor coupled to the pump;

a driveshaft having an axis of rotation and extending from the hydraulic motor to the hydraulic pump, wherein the hydraulic motor is configured to rotate the driveshaft and drive the hydraulic pump;

a rotating seal disposed about the driveshaft and configured to form a seal between the hydraulic motor and the hydraulic pump;

wherein the rotating seal comprises two thrust members disposed about the driveshaft on opposite sides of a double tapering block disposed about the driveshaft, wherein each thrust member has a spherical head that engages the tapering block, wherein one of the thrust members is eccentrically oriented relative to the axis of rotation of the driveshaft, wherein the driveshaft extends through both thrust members and the tapering block; and wherein the hydraulic pump includes a fixed barrel disposed in the housing and a plurality of circumferentially-spaced pistons, wherein each piston slidingly engages a mating throughbore extending axially through the fixed barrel, and wherein the fixed barrel is rotationally fixed relative to the housing.

2. The device of claim 1, wherein each piston has a head that bears against an inclined plate.

3. The device of claim 2, wherein the hydraulic motor is a piston motor.

4. The device of claim 3, wherein the pistons of the hydraulic motor are axial pistons that bear against an inclined plate.

5. The device of claim 1, wherein the hydraulic motor is fed from the surface of the well at a pressure higher than the delivery pressure of the pump, the hydraulic pump and the hydraulic motor each having a cylinder capacity, said cylinder capacitys being the same or almost the same.

6. The device of claim 1, wherein the hydraulic fluid present in the hydraulic motor enclosure is at the same pressure as the static pressure provided by the depth of the well.

7. The device of claim 1, wherein a slight leakage flow is arranged to be present in the rotating seal and in passing through a non-return valve this communicates with the internal space of the well.

8. The device of claim 2, wherein an inlet valve and a delivery valve are provided for each throughbore in the fixed barrel.

9. The device of claim 1, wherein the hydraulic pump enclosure has a lubricating fluid within it, and is fitted with a piston accumulator loaded by a spring to slightly pressurise the lubricating fluid.

10. The device of claim 1, further comprising a delivery column extending from the hydraulic pump to the surface, wherein the hydraulic pump comprises inlet openings fitted with filters and in communication with fluid outside the pump, wherein non-return valves calibrated to a pressure higher than that of the delivery column are provided between the delivery column and the inlet openings to clear the filters.

11. The device of claim 1, wherein the housing comprises a heat exchanger including a plurality of radially extending fins.

12. The device of claim 1, wherein a slight leakage flow is arranged to be present in the rotating seal and in passing through a non-return valve this communicates with the internal space of the well which is filled with a compound.

* * * * *